US006247735B1

(12) United States Patent
Berkman

(10) Patent No.: US 6,247,735 B1
(45) Date of Patent: Jun. 19, 2001

(54) TRIANGULAR TROUGH SCOOP

(75) Inventor: Samuel Berkman, Pt. Pleasant, NJ (US)

(73) Assignee: Nu-Tec Corp., Pt. Pleasant, NJ (US)

( * ) Notice: Subject to any disclaimer, the term of this patent is extended or adjusted under 35 U.S.C. 154(b) by 0 days.

(21) Appl. No.: 09/591,941

(22) Filed: Jun. 12, 2000

(51) Int. Cl.[7] ..... A01K 29/00; E01H 1/12
(52) U.S. Cl. ..... 294/1.3; 294/55
(58) Field of Search ..... 294/1.3, 25, 55; 15/104.8, 257.1; 206/223, 496, 577; 229/115, 116, 117.12

(56) References Cited

U.S. PATENT DOCUMENTS

D. 233,158 * 10/1974 Lowe ..... 294/1.3 X
D. 328,809 * 8/1992 Shooter ..... 294/1.3 X
3,885,266 * 5/1975 Nafziger ..... 294/1.3
4,155,581 * 5/1979 Kanaga ..... 294/1.3
4,215,886 * 8/1980 Naderi et al. ..... 294/1.3
4,251,097 * 2/1981 Whitten ..... 294/1.3
4,909,553 * 3/1990 Hantover ..... 294/1.3
5,865,486 * 2/1999 Bussani ..... 294/1.3

FOREIGN PATENT DOCUMENTS

2249470 * 5/1992 (GB) ..... 294/1.3
8500814 * 10/1986 (NL) ..... 294/1.3

* cited by examiner

*Primary Examiner*—Johnny D. Cherry
(74) *Attorney, Agent, or Firm*—Stephan Siegel

(57) ABSTRACT

A scoop for conveniently picking up waste, such as dog feces, is constructed from a single sheet of thin material and developed into a triangular shape with sloping sides and rearwardly directed handle. The scoop configuration is of a shape which allows a plurality of scoops to be nested together in a convenient package.

6 Claims, 4 Drawing Sheets

TRIANGULAR TROUGH SCOOP

FIELD OF THE INVENTION

The invention relates to disposable scoops suitable for removal of dog feces.

BACKGROUND OF THE INVENTION

It has now come to pass that through either legal, ethical or moral requirements, disposal of dog feces in a clean and least unobtrusive manner is desirable. Apparatus which facilitates such fecal matter removal in a convenient manner is also desirable. Notwithstanding the aforesaid use, the subject invention is suitable for alternative similar uses such as the removal of vomit and other biological, or chemical disposables.

In the disposal of undesirable waste products, it is particularly desirable to isolate the offensive waste products from contact with the person performing the disposing process. In addition, the devices used to remove the waste may become soiled or contaminated posing an unsanitary condition in and of itself. It is therefore of particular importance to have the ability to obtain an inexpensive, disposable receptacle which effectively isolates the receptacle's contents from the hand of the user.

In the manufacturing process of a disposable scoop, it is desirable to utilize the least material necessary to perform the given function and at the same time create the least material waste. By eliminating material waste, a manufacturing cost is eliminated making the product less expensive to manufacture. It is additionally desirable to fabricate a product which may be nested together, one inside another, which in turn facilitates transportation of the product in desirable quantities.

SUMMARY OF INVENTION

It is an object of the invention to provide an implement which can easily and effectively scoop waste matter, such as dog feces and do so without the need for an additional aid such as a paddle.

It is also an object of the invention to create a scoop having geometry which will effectively hold waste contents in a manner least likely to contact the hands of the user.

It is still further an object of the invention to form such implement in a cost effective manner from a single sheet of material while leaving the least amount of material waste.

The invention is developed from a single sheet of substantially rectangular material, such as cardboard, by folding along pre-depressed fold lines to form a triangular shaped trough. A rear juncture formed from the resulting folds is then fastened together by means of a staple or adhesive. Fractured portions of the side walls of the invention are folded rearwardly to form handles to manipulate the device.

The resulting configuration produces a device in the form of a scoop having side walls that converge to a rear juncture which juncture is sloped forward to aid in capturing and retaining contents of the scoop. Integrally formed handles are angled to facilitate a downward force component on the front of the scoop to assist in gathering waste products.

Additional objects and features of the invention will be evident from the following description taken in conjunction with the accompanying drawings.

DESCRIPTION OF THE PREFERRED EMBODIMENT

Figure 1:
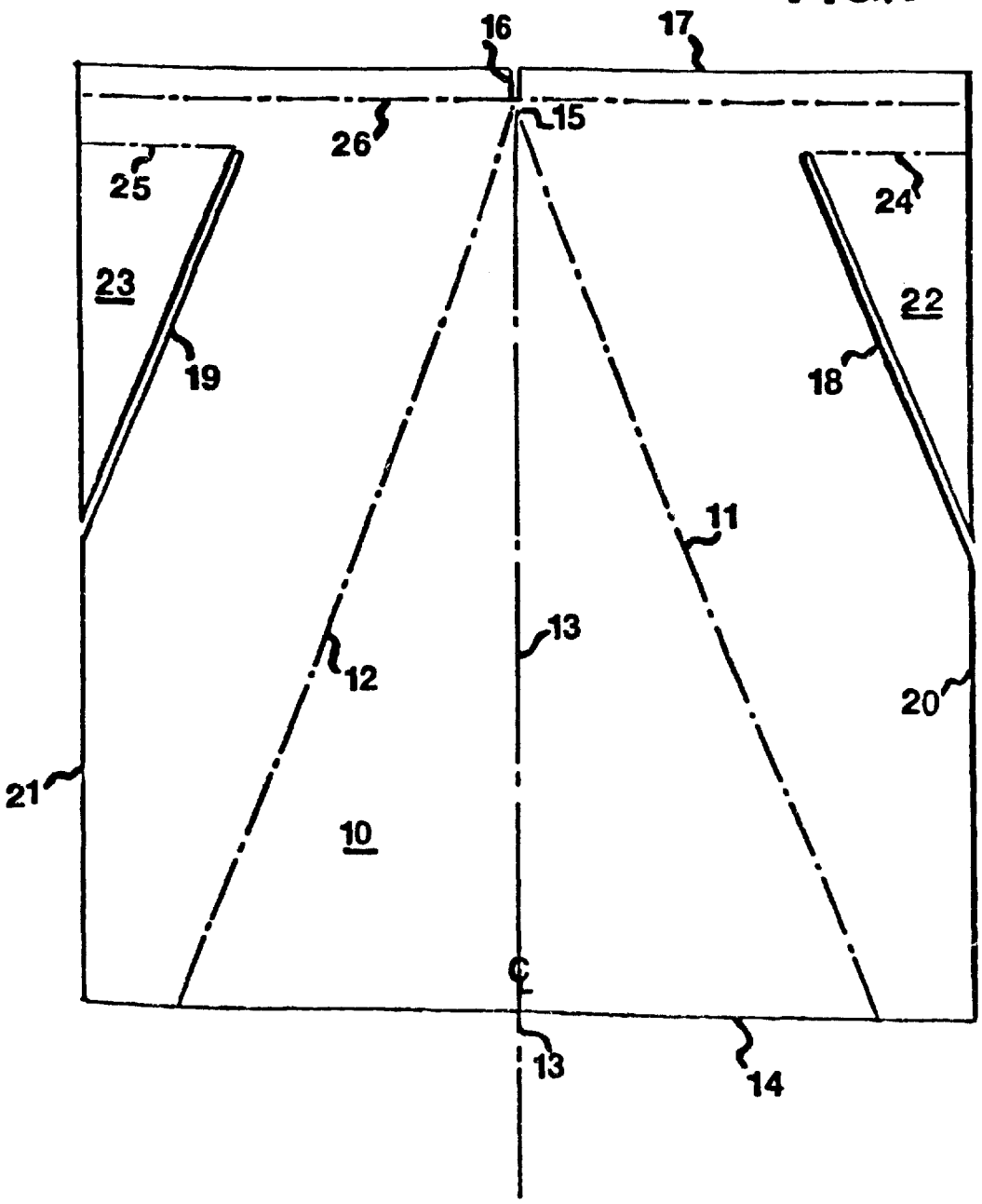
FIG. 1 is a plan view of a blank showing slits and fold lines, developable into a scoop.
Figure 1A:
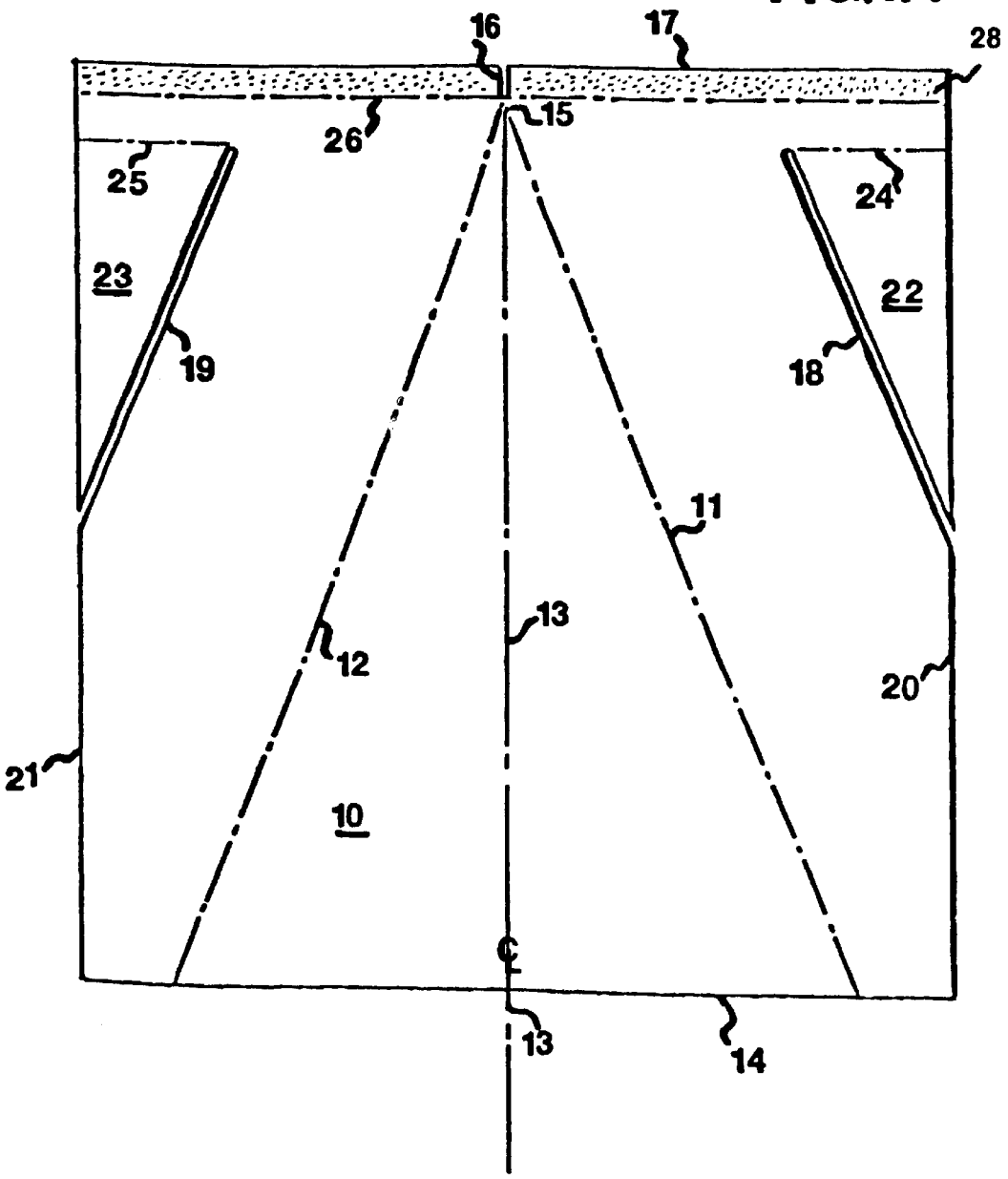
FIG. 1A is a plan view of a blank showing the location of adhesive material.

With reference to FIG. 1, a thin rectangular blank 10, preferably formed of a corrugated cardboard material, embodies the invention. Blank 10 incorporates fold lines 11 and 12 symmetrically disposed about a median 13 running anti-parallel from perimeter side 14 to a point 15 along median 13. A slit 16 extends from point 15 along median 13 to perimeter side 17. Slits 18 and 19 respectively commence along perimeter sides 20 and 21 and terminate respectively at fold lines 24 and 25 to form handles 22 and 23. A fold line 26, parallel to perimeter side 17, passes through the terminus of slit 16.

Figure 2:
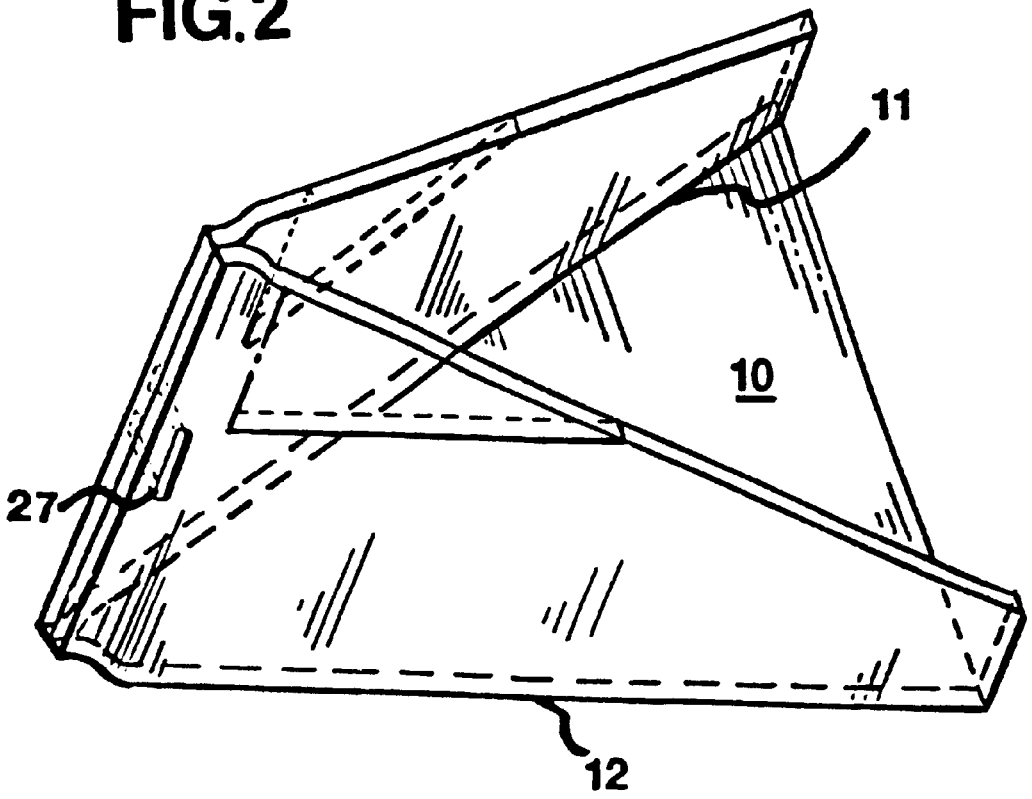
FIG. 2 is a perspective view of the invention prior to the deployment of the integrated handles.

With reference to FIG. 2, the blank 10 is folded at substantially right angles along fold lines 11 and 12 to form a triangular shaped enclosure.

Figure 3:
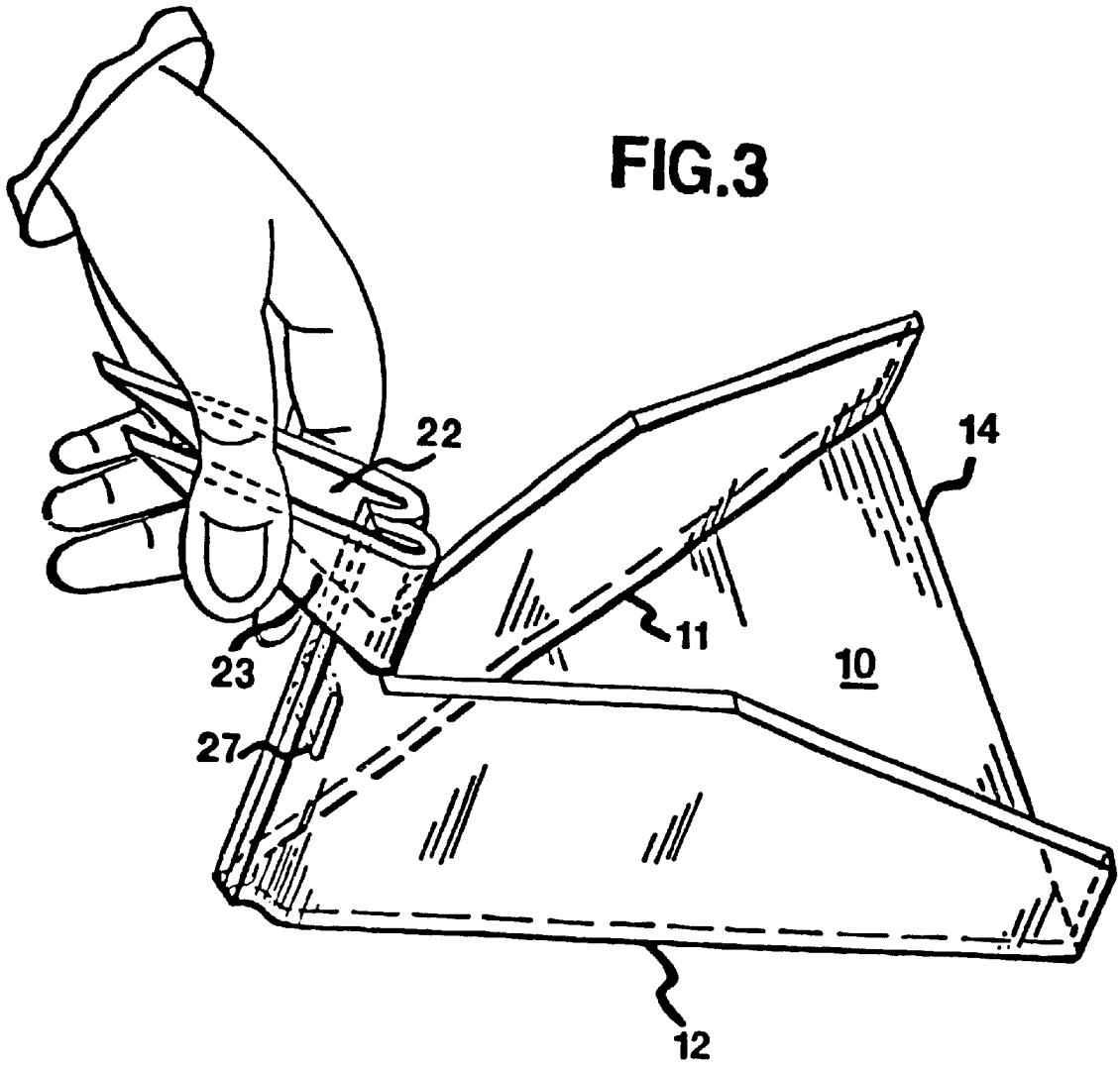
FIG. 3 is a perspective view of the invention with the integrated handles deployed.

With reference to FIG. 3, handles 22 and 23 are folded rearwardly and respectively along fold lines 24 and 25.

DETAILED DESCRIPTION OF THE PREFERRED EMBODIMENT

As shown in FIG. 1, a substantially rectangular blank 10 of corrugated cardboard or other similar material having fold lines 11 and 12 is formed into a triangular trough by folding along said lines, inwardly and to a right angle such that perimeter side 17 is folded in half with resulting edge halves in intimate contact with each other (FIG. 2). A staple 27 is inserted parallel to and in between perimeter side 17 and fold line 26 to fasten the folded halves of perimeter side 17 together. The fold line aids in bringing the fastened rear portions of the scoop into intimate touching relationship. Although a staple is shown as the coupling means in this embodiment, other fastening means including adhesive means 28 may be used to fasten together the two edges of folded perimeter side 17. To facilitate transportation and packaging of the scoop, a large plurality of scoops may be nested together, one in the other. In this manner, a minimum of space will be utilized for their packaging and transport.

Handles 22 and 23 are folded respectively along lines 24 and 25 substantially 180 degrees from their initial position, in opposite directions, to form the means by which the scoop is preferably held and directed to envelop the disposable waste products such as dog feces (FIG. 3). In the resultant rearwardly folded position, handles 22 and 23 are angularly disposed with respect to the triangular base formed by fold lines 11, 12 and perimeter side 14. The angular relationship of the scoop handles to the front edge of the scoop facilitates the capture of disposable waste by causing a downward force to this front edge when the resultant scoop is moved forward along the plane in which the disposable matter is located. Waste matter captured in the scoop is kept away from the operator's hand by virtue of the near vertically disposed rear edge of the scoop formed by folded perimeter side 17 which forms an angle of less than 90 degrees with the base of the coop. An angle of less than ninety degrees is preferable in that it causes the rear edge of the scoop to more effectively envelope the captured waste material.

I claim:

1. A three sided scoop comprising: a substantially rectangular blank of uniform thickness having two symmetrically disposed, antiparallel, intersecting fold lines; two antiparallel sides formed along respective ones of said antiparallel fold lines; symmetrically disposed fold lines terminating at the intersection of said antiparallel fold lines; edge-defined areas formed along said last mentioned symmetrically disposed fold lines which are brought into intimate contact when said antiparallel sides are formed; coupling means for retaining said edge-defined areas in intimate contact; and symmetrically disposed slits in respective ones of said antiparallel sides permitting portions of said antiparallel sides to be folded rearwardly to form a handle.

2. The scoop of claim 1 wherein said slits are disposed in substantially parallel relationship to respective ones of said antiparallel fold lines.

3. The scoop according to claim 1 wherein said coupling means comprises a staple.

4. The scoop in accordance with claim 1 wherein said coupling means comprises an adhesive bonding material.

5. The scoop according to claim 1 wherein said antiparallel sides are formed by folding said blank to substantially 90 degree angles along respective ones of said antiparallel fold lines.

6. The scoop in accordance with claim 5 incorporating a slit extending symmetrically from the intersection of said antiparallel fold lines.

* * * * *